US005642685A

United States Patent [19]

Garnier

[11] Patent Number: 5,642,685

[45] Date of Patent: Jul. 1, 1997

[54] INFLATABLE SMALL CRAFT

[75] Inventor: Gérard Garnier, Rochefort-sur-Mer, France

[73] Assignee: Zodiac International, Issy les Moulineaux, France

[21] Appl. No.: 603,101

[22] Filed: Feb. 20, 1996

[30] Foreign Application Priority Data

May 19, 1995 [FR] France ..... 95 05993

[51] Int. Cl.[6] ..... B63B 7/08

[52] U.S. Cl. ..... 114/345

[58] Field of Search ..... 114/345; 441/40, 441/66

[56] References Cited

U.S. PATENT DOCUMENTS

| | | | |
|---|---|---|---|
| 4,545,319 | 10/1985 | Ferronniere et al. | 114/345 |
| 4,640,217 | 2/1987 | Ferronniere | 114/345 |
| 4,722,292 | 2/1988 | Marino et al. | 114/345 |

FOREIGN PATENT DOCUMENTS

| | | |
|---|---|---|
| 0 154 964 | 9/1985 | European Pat. Off. . |
| 1 277 002 | 10/1961 | France . |
| 1 964 657 | 7/1971 | Germany . |
| 2 102 741 | 2/1983 | United Kingdom . |

*Primary Examiner*—Sherman Basinger
*Attorney, Agent, or Firm*—Larson and Taylor

[57] ABSTRACT

Inflatable small craft including at least one inflatable tube (1) forming two substantially parallel branches (2) meeting towards the front to form a stem (3), a bottom sheet (5) forming a V-shaped hull held taut by a longitudinal keel (6) which is interposed between a bottom (4) which is rigid in the transverse direction held along the two aforementioned branches (2) and the bottom sheet (5) which is connected to the tube (1) along the peripheral edges of the bottom (4). The craft additionally includes two auxiliary floats (7) running under the bottom (4) substantially parallel to the respective branches (2) while being offset towards the center with respect to these branches. The auxiliary floats extend close to the branches while being physically separate from them.

8 Claims, 2 Drawing Sheets

INFLATABLE SMALL CRAFT

FIELD OF THE INVENTION

The present invention relates to improvements made to inflatable small craft including at least one inflatable tube forming two substantially parallel branches meeting towards the front to form a stem, a bottom sheet forming a V-shaped hull held taut by a longitudinal keel which is interposed between a bottom which is rigid in the transverse direction held along the two aforementioned branches and the said bottom sheet which is connected to the said tube along the peripheral edges of the bottom.

BACKGROUND OF THE INVENTION

To improve the characteristics of steerability at high speed (comfort, ease with which it lifts out of the water, how well it holds its heading, . . . ) whilst at low or medium speeds maintaining correct immersion of the propeller, it has already been proposed (FR 2,398,660, FR 2,510,064) that, at least in their substantially parallel part, each of the two branches of the tube should, in cross section, exhibit a multi-lobed, especially two-lobed shape, the major axis of which is inclined, and in which the upper compartment exhibits a larger cross section than the lower compartment; furthermore, a lateral sheet is fixed tangentially to at least some of the lobes of the outer side of the branch in question, and in particular is fixed tangentially to the large upper lobe and to the small lower lobe of the two-lobed structure, these lateral sheets constituting lateral lift planes on which the upthrust is exerted.

Small craft of this type are completely satisfactory and have been very widely developed.

However, the multi-lobed structure of each branch is complicated to manufacture and is therefore expensive. For this reason, this improved structure has hitherto been reserved for top-of-the-range craft.

However, there is now a demand for small craft at the bottom or in the middle of the range which exhibit the aforementioned steerability advantages whilst retaining a manufacturing cost which is lower than that which the use of a multi-lobed structure as described above entails.

SUMMARY OF THE INVENTION

The object of the invention is therefore essentially to propose an improved structure capable of affording the desired advantages (especially comfort, ease with which it lifts out of the water, and which holds its heading well) while being simple and less expensive to employ in manufacture, and which therefore allows small craft having the desired characteristics to be produced in mid-range and even at the bottom of the range.

To these ends, the invention proposes an inflatable small craft of the type mentioned in the preamble which, being designed in accordance with the invention is essentially characterized in that it additionally includes two auxiliary floats running under the bottom substantially parallel to the said respective branches while being offset towards the centre with respect to these, said auxiliary floats running close to the branches while being physically separate from them.

Such a structure makes it possible to lay aside the difficulties in producing the multi-lobed structures used hitherto. Indeed, the main tube is designed and manufactured in the way commonly employed for small craft with simple inflatable structure, having just one inflatable tube which have been known since prior to the small craft with multi-lobed structure. As far as the auxiliary floats are concerned, they may be the subject of individual manufacture and then be attached: as a result of this, not only can they be manufactured simply and economically, but they can also be fixed on simply and relatively inexpensively as will become clear later.

By way of preference, the two auxiliary floats are secured to the said bottom sheet, preferably on the underside thereof.

Advantageously, the two auxiliary floats have their lower edge situated substantially lower down than the lower edge of the keel. Likewise, it is desirable for the two auxiliary floats to have their lower edge situated substantially lower down than the lower edge of each branch of the tube.

To fix it on, each auxiliary float may comprise an inflatable chamber and two continuous or discontinuous skirts running longitudinally respectively on each side of the chamber and secured under the bottom sheet.

However, it would seem quicker and simpler according to a preferred embodiment, to contrive for each auxiliary float to comprise a longitudinally elongate pocket secured under the bottom sheet and an inflatable chamber made in the form of an individual element independent of the pocket and inserted into the said pocket.

By way of preference, the keel is an inflatable keel consisting of at least one elongate inflatable chamber.

In a preferred embodiment, the edge of the interior wall of each pocket is pressed against and secured to the bottom sheet, pointing towards the closest edge thereof and when the chambers of the auxiliary floats and the keel are inflated, the two auxiliary floats are substantially pressed against the underside of the bottom, the bottom sheet forming, with the keel, a V-shaped central hull running transversely between the two auxiliary floats and the wall of the pockets of the auxiliary floats which is situated laterally towards the outside running at an angle acting like a lateral lift plane on which the upthrust is exerted.

BRIEF DESCRIPTION OF THE DRAWINGS

The invention will be better understood from reading the description which follows of a few embodiments which are given solely by way of non-limiting examples. In this description, reference is made to the appended drawings in which.

DESCRIPTION OF THE PREFERRED EMBODIMENTS

Figure 1:
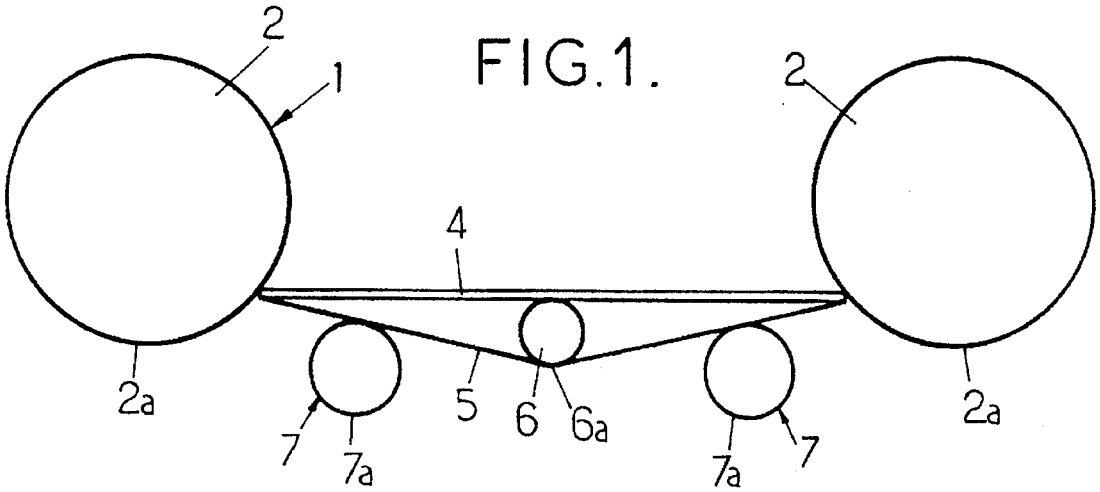
FIG. 1 is a simplified view in cross section of one basic design or an inflatable small craft in accordance with the invention.

As visible in FIG. 1, the small craft includes a main inflatable tube 1 forming two substantially parallel branches 2 which meet towards the front to form a stem 3.

A rear board (not visible) connects the rear ends of the two branches 2 and is intended to take at least one engine, especially of the outboard type (not represented).

Held along the two branches 2 of the small craft is a floor or bottom 4 which is rigid in the transverse direction. This bottom may consist of the juxtaposition of slats or rigid panels secured together in an articulated fashion, or alternatively may consist of at least one flat and planar pocket inflated to a relatively high pressure. A bottom sheet 5 situated underneath the bottom 4 is connected to the peripheral edges of the bottom 4, along the joint between the latter and the tube 1. Interposed between the bottom 4 and the bottom sheet 5 is a keel 6 which holds the bottom sheet 5 taut to give it the form of a V-shaped hull. By way of preference, the keel 6 is an inflatable keel consisting of at least one elongate inflatable chamber.

Finally, offset towards the centre with respect to the branches 2 of the main tube 1, two auxiliary floats 7 are situated under the bottom 4 and run substantially parallel to the said branches 2, close to them while being physically separate from them. The two auxiliary floats 7 are configured so that their lower edge 7*a* is situated substantially lower down than the lower edge 6*a* of the keel, and possibly also lower down than the lower edge 2*a* of the branches 2, depending on the steerability characteristics which the small craft is to be given.

Although, within the scope of the invention, it is possible to envisage arrangements in which the auxiliary floats are interposed between the bottom and the bottom sheet thanks to suitable design of the way the latter is fixed to the bottom, it does, however, seem simpler to anticipate fixing the two auxiliary floats 7 to the outer face or underside of the bottom sheet 5.

Figure 2:
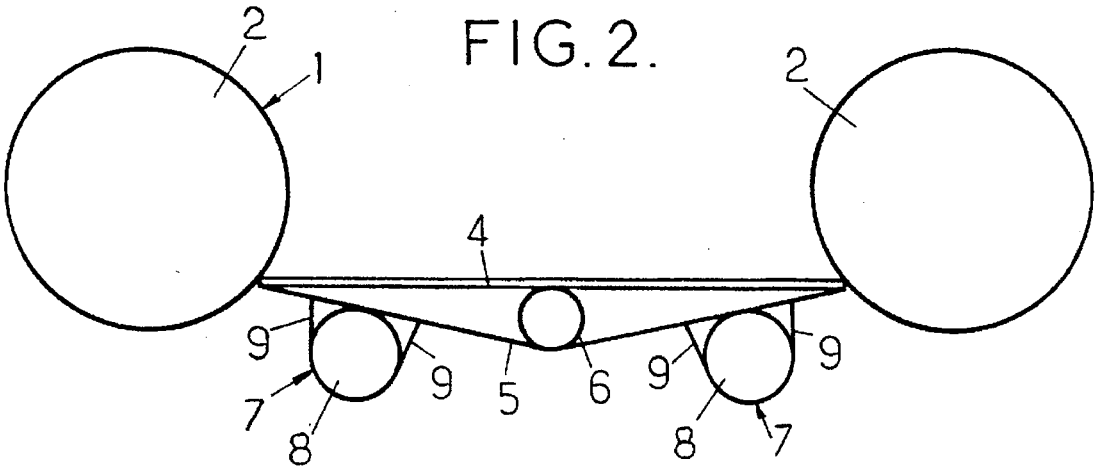
FIGS. 2 and 3 are simplified views in cross section respectively of two other embodiments of small craft in accordance with the invention.

To fix each float 7 to the bottom sheet 5, it is possible to contrive for each float 7 to comprise an elongate inflatable chamber 8 and two skirts 9 which run longitudinally on each side of the said chamber 8 and which are secured, for example by welding, to the outer face of the bottom sheet 5, as represented in FIG. 2. Each skirt may be discontinuous, but it is preferably continuous in order to avoid turbulence in the liquid flow over its faces.

Figure 3:
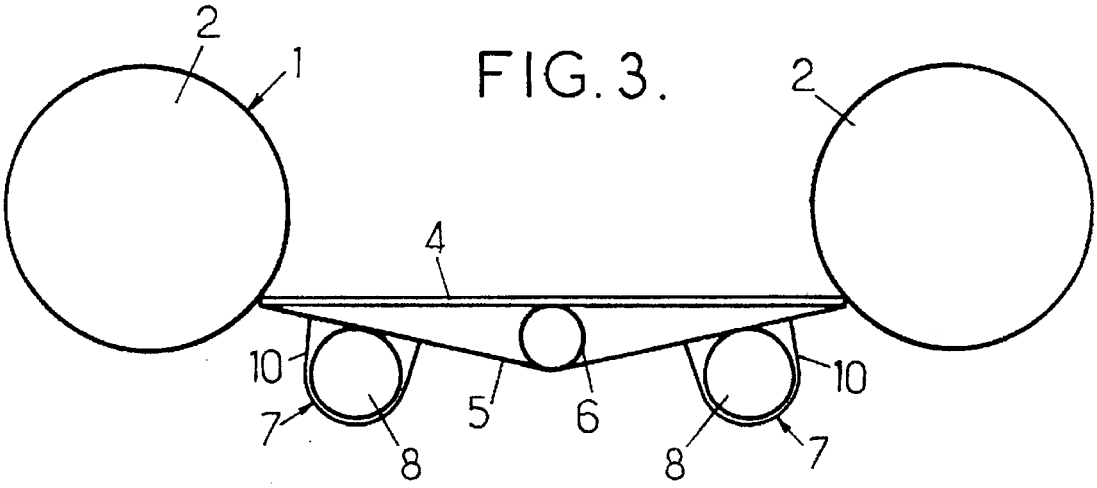

In another embodiment represented in FIG. 3, each auxiliary float 7 comprises an elongate pocket 10 fixed to the outer face of the bottom sheet 5 and running substantially parallel to the adjacent respective branch 2 of the main tube 1; an elongate inflatable chamber 8 made individually in the form of an independent element is inserted inside the said pocket 10.

Figure 4:
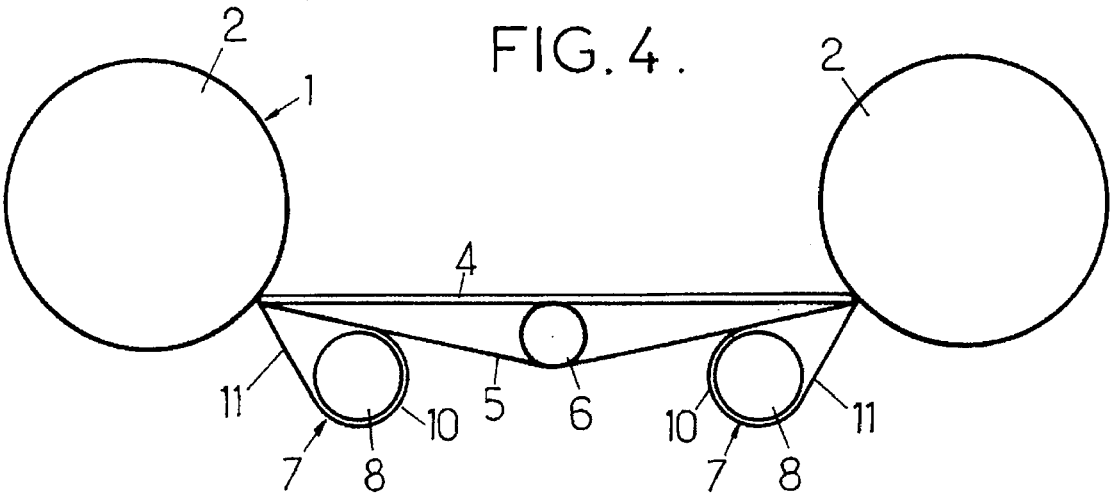
FIG. 4 is a simplified view in cross section of a preferred embodiment of a small craft in accordance with the invention.

FIG. 4 shows a preferred embodiment which constitutes one alternative form of the small craft of FIG. 3. The two auxiliary floats 7 are, when the keel 6 and the chambers 8 are in the inflated state, pressed against the lower face of the bottom 4; the bottom sheet 5, held taut by the keel 6, forms a central V-shaped hull running transversely between the two auxiliary floats 7; finally, the wall 11 of the pockets 10 which is situated laterally towards the outside runs at an angle and acts as a lateral lift plane on which the upthrust is exerted, in place of the sheet attached on laterally to the two-lobed branches of the structures of the prior art.

Figure 5:
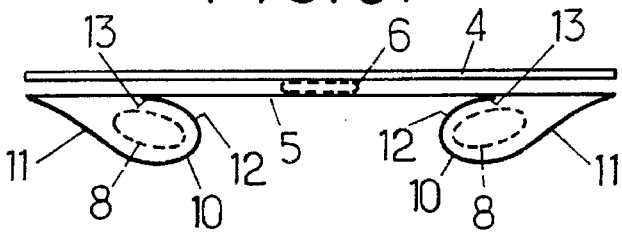
FIG. 5 is a simplified view in cross section showing the design of the body sheet and of its pockets, in the non-inflated condition, used in the small craft of FIG. 4.

For it to be possible for the configuration shown in FIG. 4 to be obtained simply by inflating the keel 6 and the two chambers 8, the pockets 10 have to be arranged as represented in FIG. 5. In this FIG. 5, the bottom sheet 5 is represented in the flat, taut state, the keel 6 and the chambers 8 not having been inflated. It may be seen that the wall 12 of the pockets 10 which is situated laterally towards the inside has its longitudinal edge 13 pressed flat against the bottom sheet 5 and secured thereto, pointing towards the closest edge of the said bottom sheet. As the longitudinal edge of the other wall 11 is fixed in the same fashion, the structural dissymmetry 1 of each pocket 10 leads, after the chambers 8 and the keel 6 have been inflated, to the dissymmetry of shape visible in FIG. 4.

Figure 6:
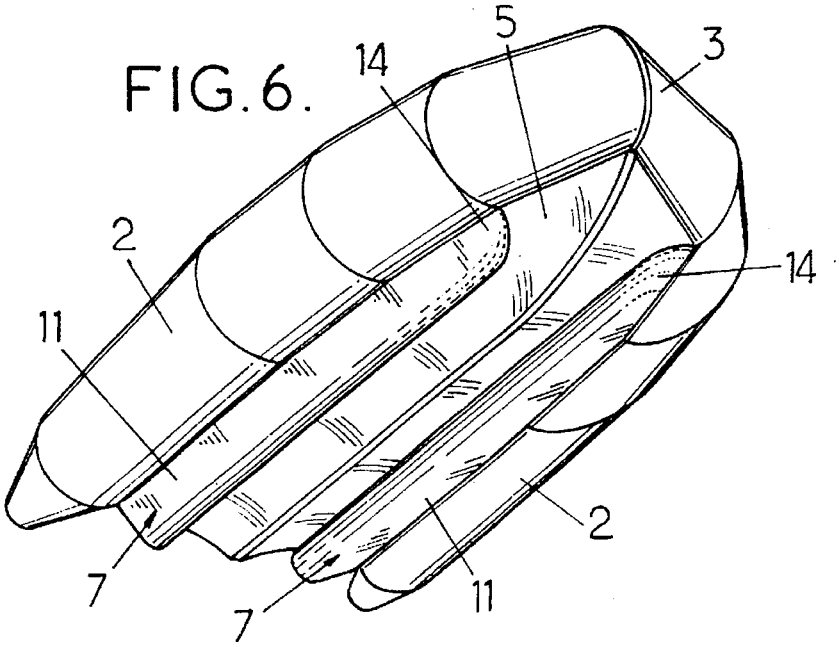
FIG. 6 is a view from beneath, in perspective, of the small craft of FIG. 4.

FIG. 6 is a view from beneath in perspective of the small craft of FIG. 4, allowing an appreciation of the longitudinal shape of the hull. The two auxiliary floats 7 run over a length corresponding approximately to the length of the substantially parallel branches 2 of the main tube 1. Their front end 14 meets the bottom sheet 5 in a profiled manner.

As goes without saying, and as already stems from the foregoing, the invention is in no way limited to those of its methods of application and embodiments which have been more particularly envisaged; on the contrary, it encompasses all alternative forms thereof.

I claim:

1. An inflatable small craft including at least one inflatable tube forming two substantially parallel branches meeting towards the front to form a stem, a bottom sheet forming a V-shaped hull held taut by a longitudinal keel which is interposed between a bottom which is rigid in the transverse direction held along said two branches and said bottom sheet which is connected to said tube along the peripheral edges of the bottom, two auxiliary floats extending under the bottom substantially parallel to the said two branches while being spaced from and offset towards the center with respect to said branches, said two auxiliary floats being secured to the bottom sheet underneath said sheet.

2. An inflatable small craft according to claim 1, wherein said auxiliary floats extend close to the said branches while being physically separate from said branches.

3. An inflatable small craft according to claim 1, wherein the keel has a lower edge and the two auxiliary floats each have a lower edge situated substantially lower than the lower edge of the keel.

4. An inflatable small craft according to claim 3, wherein each branch of the tube has a lower edge and wherein the two auxiliary floats each have a lower edge situated substantially lower than the lower edge of each branch of the tube.

5. An inflatable small craft according to claim 1, wherein each auxiliary float comprises an inflatable chamber and two skirts which extend longitudinally on each side of the chamber and which are fixed under the bottom sheet.

6. An inflatable small craft according to claim 1, wherein each auxiliary float comprises a longitudinally elongate pocket secured under the bottom sheet and an inflatable chamber made in the form of an individual element independent of the pocket and inserted inside the said pocket.

7. An inflatable small craft according to claim 6, wherein each pocket includes an interior wall having a longitudinal edge and wherein the longitudinal edge of the interior wall of each pocket is pressed against and secured to the bottom sheet, the two auxiliary floats, when the chambers of the two auxiliary floats and the keel are inflated, being substantially pressed against the underside of the bottom, and the bottom sheet forming, with the keel, a V-shaped central hull extending transversely between the two auxiliary floats, and a laterally outwardly extending wall of the pockets of the auxiliary floats being disposed at an angle so as to act like a lateral lift plane on which an upthrust is exerted.

8. An inflatable small craft according to claim 1, wherein the keel comprises an inflatable keel comprising at least one elongate inflatable chamber.

* * * * *